US009492047B2

(12) United States Patent
Marsden et al.

(10) Patent No.: US 9,492,047 B2
(45) Date of Patent: Nov. 15, 2016

(54) SUCTION CLEANER

(75) Inventors: Jennifer Kathryn Marsden, Birmingham (GB); Rowan Williams, Birmingham (GB)

(73) Assignee: Techtronic Floor Care Technology Limited, Tortola (VG)

( * ) Notice: Subject to any disclaimer, the term of this patent is extended or adjusted under 35 U.S.C. 154(b) by 466 days.

(21) Appl. No.: 14/006,456

(22) PCT Filed: Mar. 22, 2012

(86) PCT No.: PCT/GB2012/050639

§ 371 (c)(1),
(2), (4) Date: Oct. 23, 2013

(87) PCT Pub. No.: WO2012/127243

PCT Pub. Date: Sep. 27, 2012

(65) Prior Publication Data

US 2014/0047665 A1 Feb. 20, 2014

(30) Foreign Application Priority Data

Mar. 23, 2011 (GB) ..... 1104892.3

(51) Int. Cl.

| | |
|---|---|
| ***A47L 9/26*** | (2006.01) |
| ***A47L 5/36*** | (2006.01) |
| ***A47L 9/14*** | (2006.01) |
| ***A47L 9/00*** | (2006.01) |
| ***A47L 9/22*** | (2006.01) |

(52) U.S. Cl.

CPC ..... *A47L 9/26* (2013.01); *A47L 5/365* (2013.01); *A47L 9/00* (2013.01); *A47L 9/14* (2013.01); *A47L 9/22* (2013.01)

(58) Field of Classification Search

CPC ..... A47L 9/26; A47L 9/90; A47L 9/14; A47L 9/22; A47L 5/365

See application file for complete search history.

(56) References Cited

U.S. PATENT DOCUMENTS

| | | | |
|---|---|---|---|
| 1,897,087 | A | 2/1933 | Jacques |
| 2,487,395 | A | 11/1949 | Strang |

(Continued)

FOREIGN PATENT DOCUMENTS

| | | | |
|---|---|---|---|
| EP | 0488014 | A1 | 6/1992 |
| EP | 1554965 | A1 | 7/2005 |

(Continued)

OTHER PUBLICATIONS

International Search Report for Application No. PCT/GB2012/050639 dated Sep. 28, 2012 (8 pages).

*Primary Examiner* — Dung Van Nguyen
(74) *Attorney, Agent, or Firm* — Michael Best & Friedrich LLP

(57) ABSTRACT

A suction cleaner (60) comprising a body (50); a compartment (42) for accommodating a dust collection bag (44); and a source of suction (32) for causing suction airflow into a bag in the compartment, wherein the source of suction is disposed at least partially beneath the compartment and communicates therewith by a passage (46) which extends from an upper region of the compartment.

20 Claims, 7 Drawing Sheets

(56) References Cited

U.S. PATENT DOCUMENTS

| | | | | |
|---|---|---|---|---|
| 2,661,074 | A | 12/1953 | Gerber | |
| 2,747,683 | A | 5/1956 | Ziegler, Jr. | |
| 2,779,432 | A | 1/1957 | Meyerhoefer | |
| 2,949,251 | A | 8/1960 | Sparklin | |
| 3,510,904 | A * | 5/1970 | Lagerstrom | A47L 9/19 15/319 |
| 4,739,535 | A * | 4/1988 | Schuld | A47L 9/0036 15/315 |
| 6,491,249 | B2 * | 12/2002 | Park | A47L 9/26 242/386 |
| 2004/0055105 | A1 | 3/2004 | Park | |

FOREIGN PATENT DOCUMENTS

| | | | |
|---|---|---|---|
| FR | 1408660 | A | 8/1965 |
| WO | 2010015966 | A1 | 2/2010 |

* cited by examiner

SUCTION CLEANER

BACKGROUND

The invention relates to a suction cleaner, more specifically to a suction cleaner which filters entrained dust out of the cleaner's suction airflow by using a dust collection bag in which the dust is retained for disposal. The cleaner described hereafter is of the so-called drum or canister type, but it will be appreciated that the principles of the invention will be applicable to cleaners whose shape differs from that described.

In suction cleaners with dust collection bags, there is a suction creating means, usually an electric motor connected to drive a fan, which transfers air from inside the suction cleaner, discharging through vents to the outside. The suction creating means is in fluid communication with the exterior of a dust collection bag, which has porous walls designed to trap dust but allow airflow therethrough. The interior of the bag is in fluid communication with an inlet which in the case of an "upright" type of cleaner is a cleaning head part of the cleaner's body, or possibly a hose, or in the case of a drum or canister type of cleaner is a suction hose, which the user directs to the area requiring cleaning. The flow created takes dust-filled air through the collection bag wherein the dust is retained, and the resultant clean air, filtered by the bag, flows to the suction creating means and thence to the outside of the cleaner.

It will be appreciated that the term "dust" is used herein as a general term to cover all of the matter that a suction cleaner would be used to collect, rather than as a literal term referring solely to household dust. For example, the term "dust" will cover hair fibres, loose carpet fibres, food particles, soil particles, wood dust, wood shavings, and any other debris, of a size which may range from microns to millimetres.

In a suction cleaner, it is desirable to have a large dust-carrying capacity, so that it requires emptying less frequently. To address this requirement, a large collection bag could be provided, but this would require a larger volume inside the cleaner and thus create a larger suction cleaner as a whole, requiring more material to manufacture and more storage space.

A favourable solution therefore is to ensure that the bag provided is filled as close as possible to its capacity, referred to herein as a high "fill ratio", and this is dependent upon the path of the airflow which carries the dust through the bag. To this end, many drum-type suction cleaners have the motor disposed overhead of the bag, because this configuration allows some of the volume above the centreline of the inlet port to be filled. However, as the motor is relatively heavy, this results in the cleaner's having a high centre of gravity, making it less stable. This makes it more likely that the cleaner will fall over in use when being pulled along by the hose, especially when the castors commonly used on such suction cleaners have to climb small level differences, such as passing over a cable on the floor, or a door threshold.

The cable for the motor must be relatively thick, due to the power required by the electric motor, which is generally above 1 kW. In addition, it is desirable to provide a long cable so that the operating range of the cleaner from a power supply socket is increased. These factors result in a heavy cable. Many suction cleaners have the cable storage towards the top of the device for ease of access by the user, but this also results in a high centre of gravity, and instability.

SUMMARY

The present invention aims to address the above-described problems.

According to one aspect of the invention, we provide a suction cleaner comprising a body; a compartment for accommodating a dust collection bag; and a source of suction for causing suction airflow into a bag in the compartment, wherein the source of suction is disposed at least partially beneath the compartment and communicates therewith by a passage which extends from an upper region of the compartment.

The arrangement, in a suction cleaner in accordance with the invention, of the dust-bag receiving compartment, the source of suction, and the passage therebetween, enables a high degree of filling of the dust bag to achieved in use. In addition, the disposition of the source of suction generally beneath the compartment gives the cleaner a low centre of gravity.

The passage between the compartment and source of suction may be afforded by a duct extending upwardly from the latter, terminating in the vicinity of an upper surface of the compartment. Preferably the duct terminates at a position generally opposite a hose inlet to the compartment.

A suction cleaner in accordance with the invention may further comprise a storage device for electrical cable, preferably in a lower part of the body of the cleaner. Such disposition of a cable storage device, conveniently a cable reel, also assists in achieving a low centre of gravity for the cleaner as a whole. The cable reel may provide for winding of the cable onto the cable reel by rotation of the latter, which rotation may be effected by a manually operable rotary member such as a crank handle.

Such a manually operable rotary member may be disposed at a side part of the body of the cleaner, rotatable about an axis which extends generally transversely of the body and also generally transversely of the axis of rotation of the cable reel.

A one-way drive device may be operative between the rotary member and cable reel, so that when cable is drawn off the cable reel the cable reel may be rotated in one direction without causing rotation of the rotary member. When cable is to be wound onto the cable reel, the rotary member may drive the cable reel in the direction to cause such winding.

BRIEF DESCRIPTION OF THE DRAWINGS

These and other features of the invention will now be described, by way of example only, with the reference to the accompanying drawings, of which.

DETAILED DESCRIPTION

Figure 1:
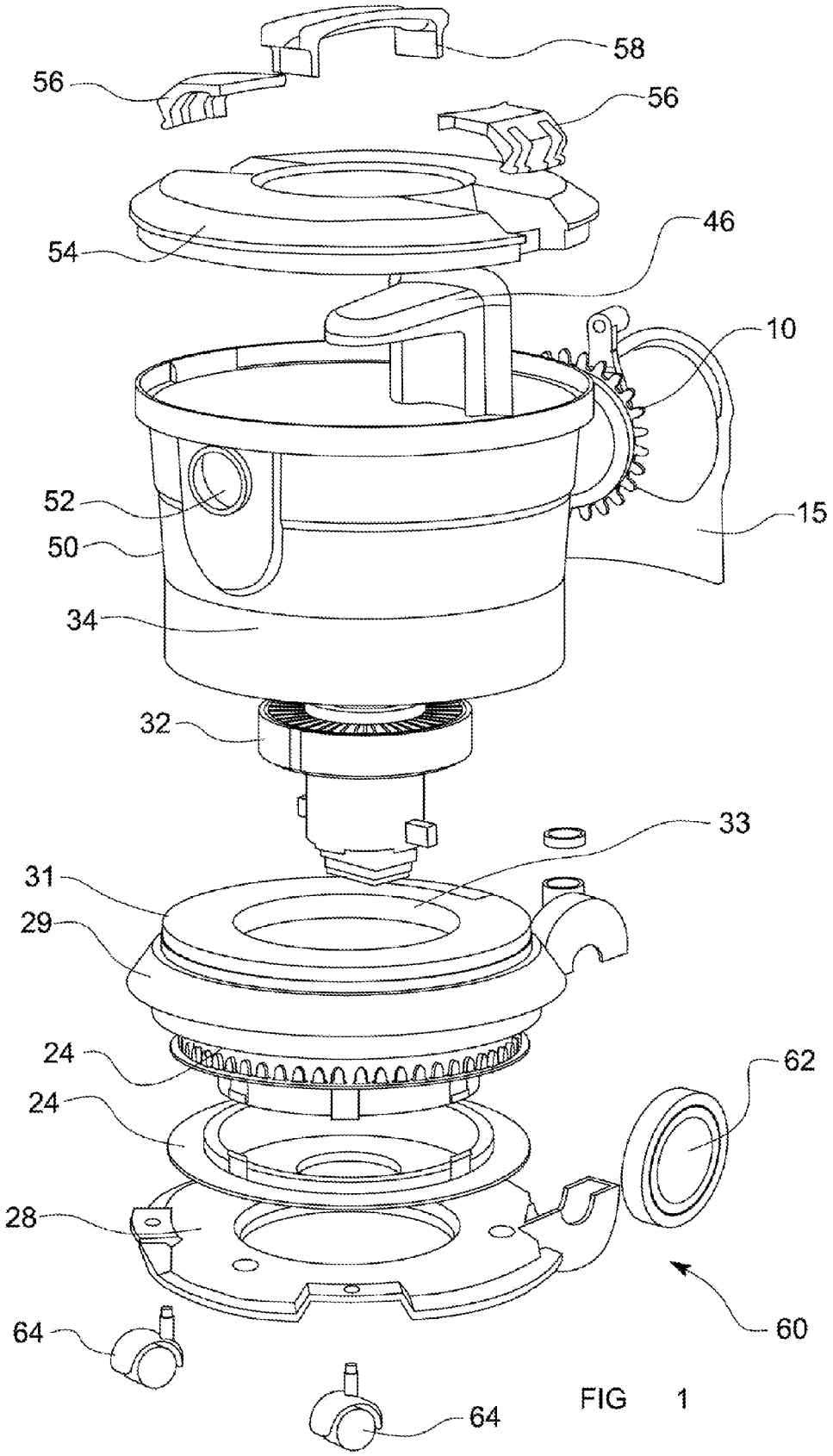
FIG. 1 is an exploded view of an embodiment of suction cleaner according to the invention, from the front.
Figure 2:
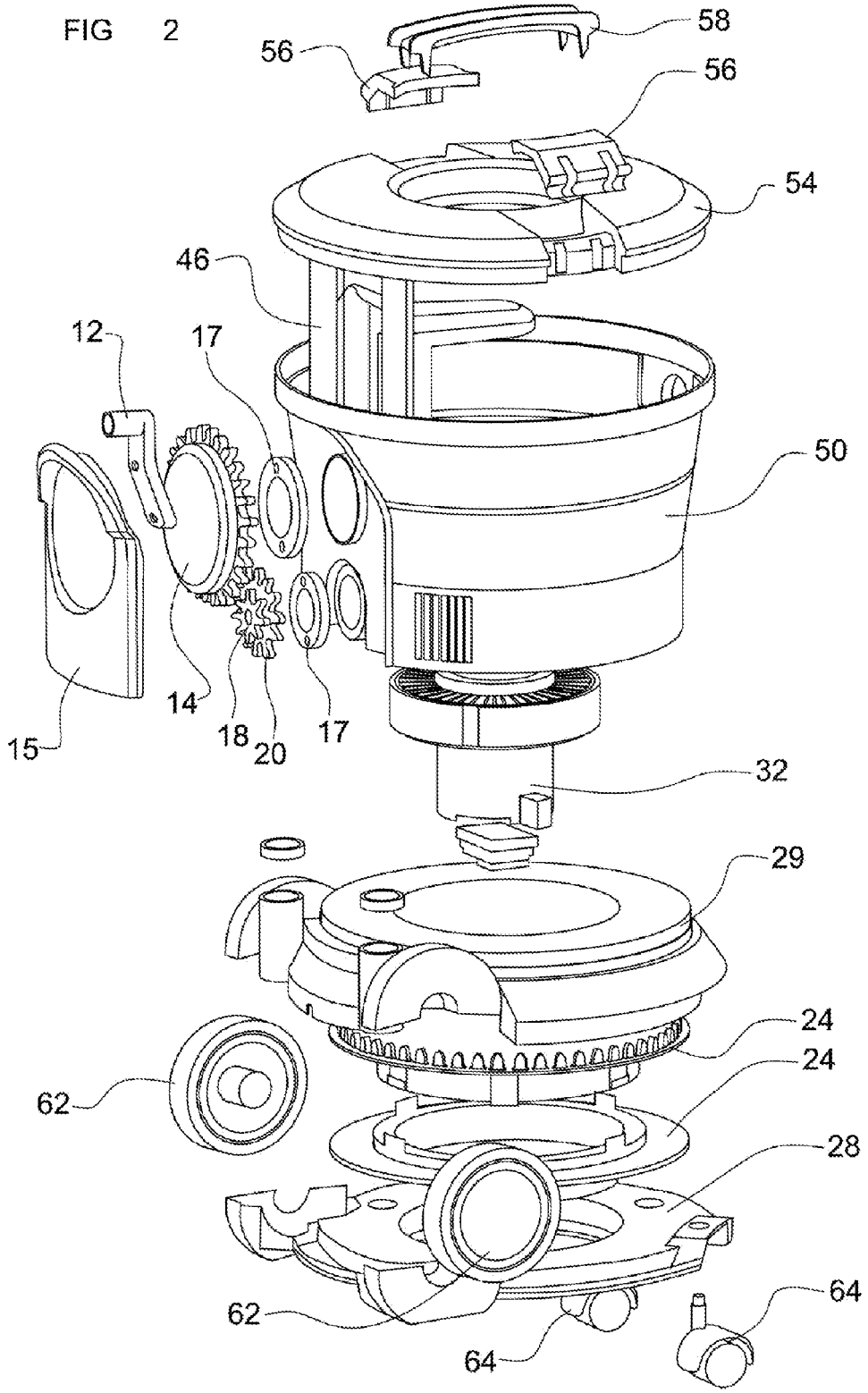
FIG. 2 is an exploded view of the suction cleaner according to the invention from the rear.

Referring to the drawings, these show the main components of a suction cleaner 60 according to the invention. It comprises an outer body 50, which conveniently is a plastics moulding of hollow and generally cylindrical configuration, and which defines an internal volume when fitted with a lid 54. The lid 54 is releasably connected to the main body 50 by means of clips 56 and is provided with a carrying handle 58.

Figure 9:
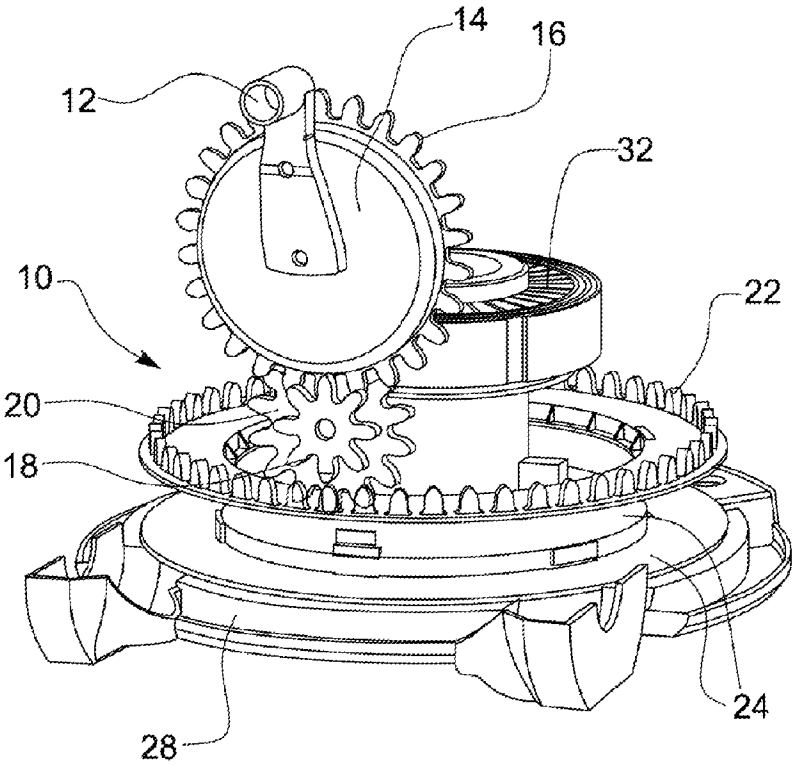

At the lower end of the body, there is a base 29 which is provided with wheels 62 and castors 64, the base 29 having a portion 31 which fits within the lower edge of the body 50, and a central recess 33. A bottom cover 28 beneath the base 29 supports an annular cable reel 24 for rotation about an upright axis, the cable reel having supporting rollers 26 (FIG. 9) which engage the bottom cover 28, so that the cable reel is mounted inside a compartment defined between base 29 and cover 28.

A suction creating device in the form of an electric motor 32, drivingly connected to a fan or impeller, is disposed in a lower portion of the cleaner 60, mounted concentrically within the cable reel 24 and supported in the recess 33 of the base 29. The cable reel 24, rotatably supported by its rollers 26 surrounds the motor 32 and is rotatable by a user operating a winding mechanism 10, described hereafter.

Figure 3:
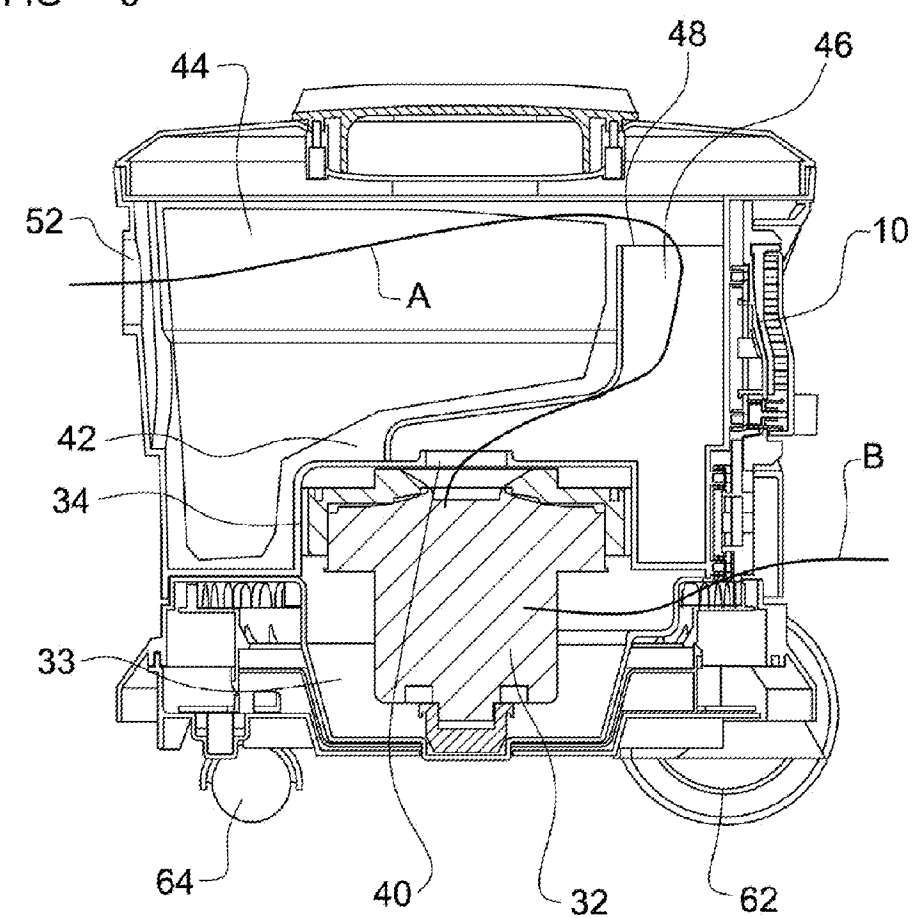
FIG. 3 is a cutaway view of the suction cleaner according to the invention from the left, with a visual representation of paths of airflow therein.
Figure 6:
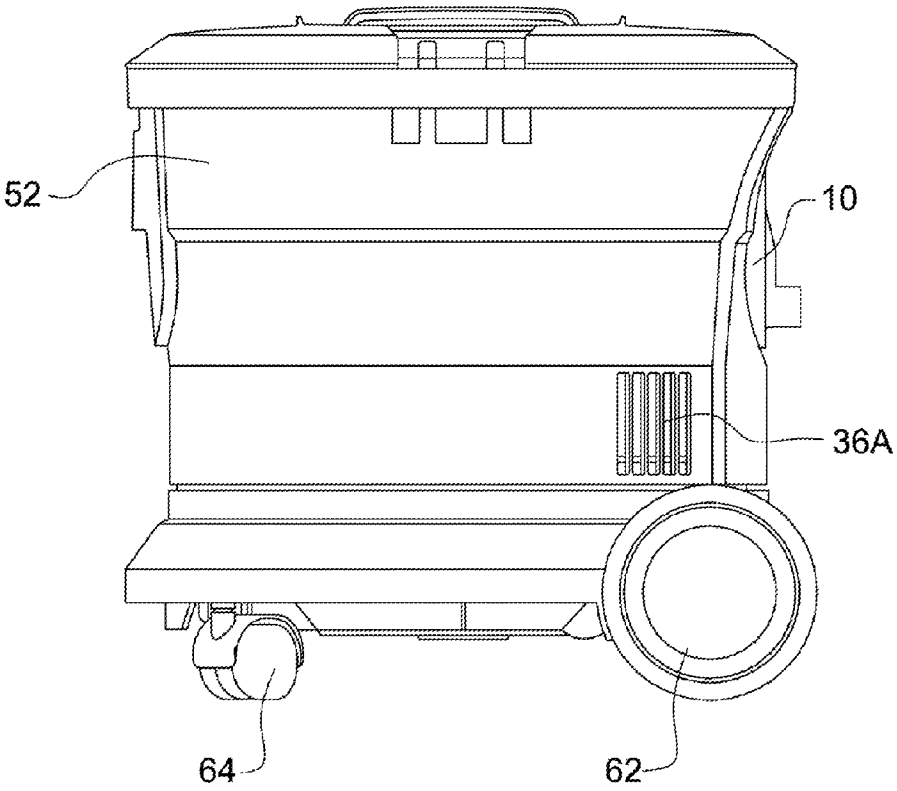
FIG. 6 shows the suction cleaner according to the invention from the left.
Figure 5:
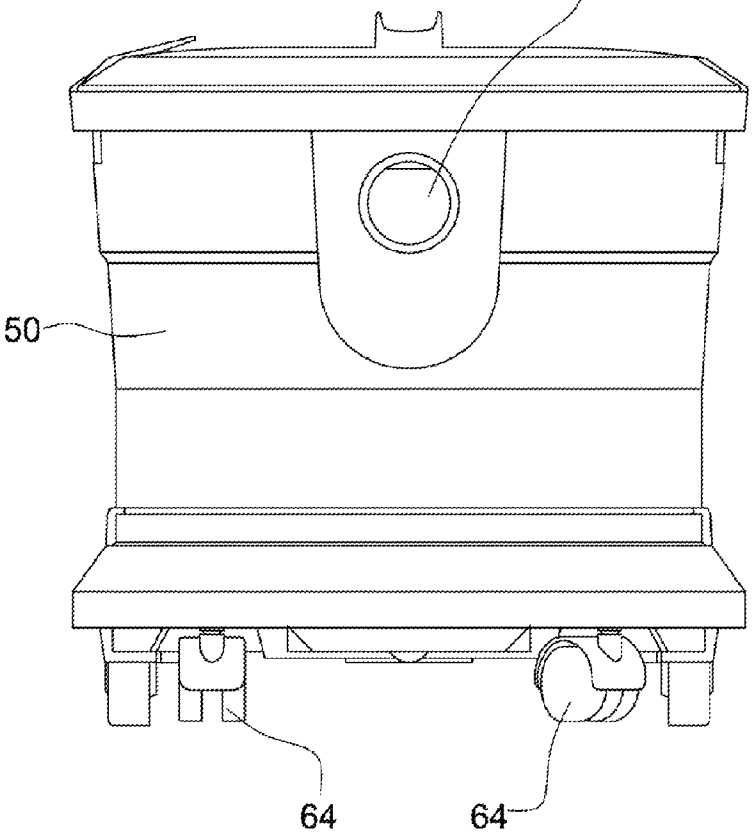
FIG. 5 shows the suction cleaner according to the invention from the front.
Figure 8:
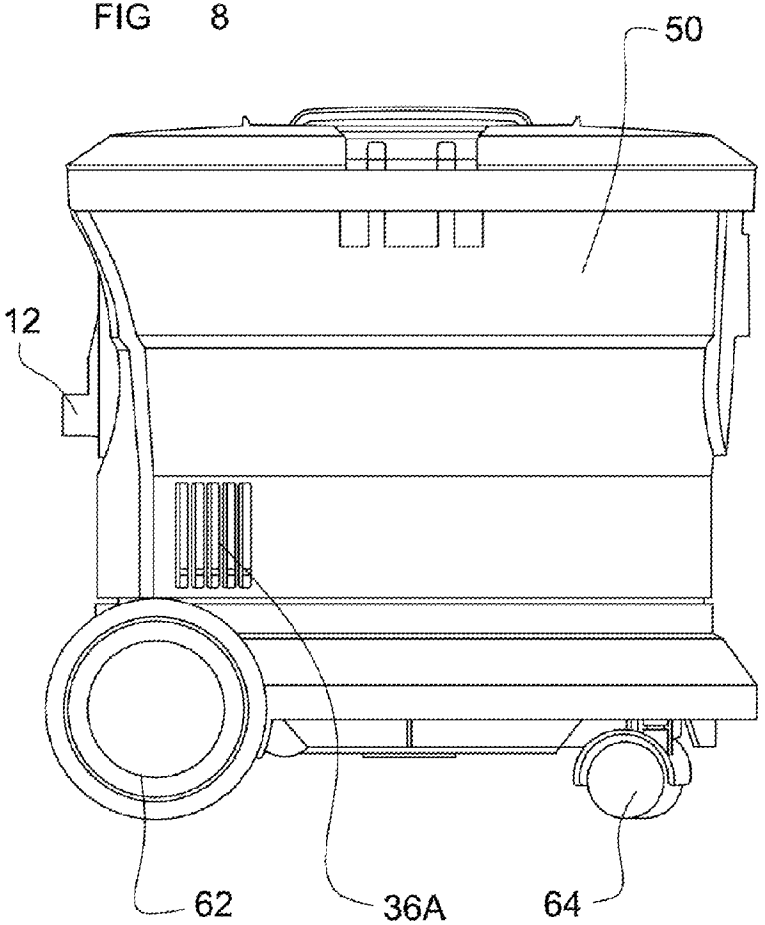
FIG. 8 shows the suction cleaner according to the invention from the right.
Figure 7:
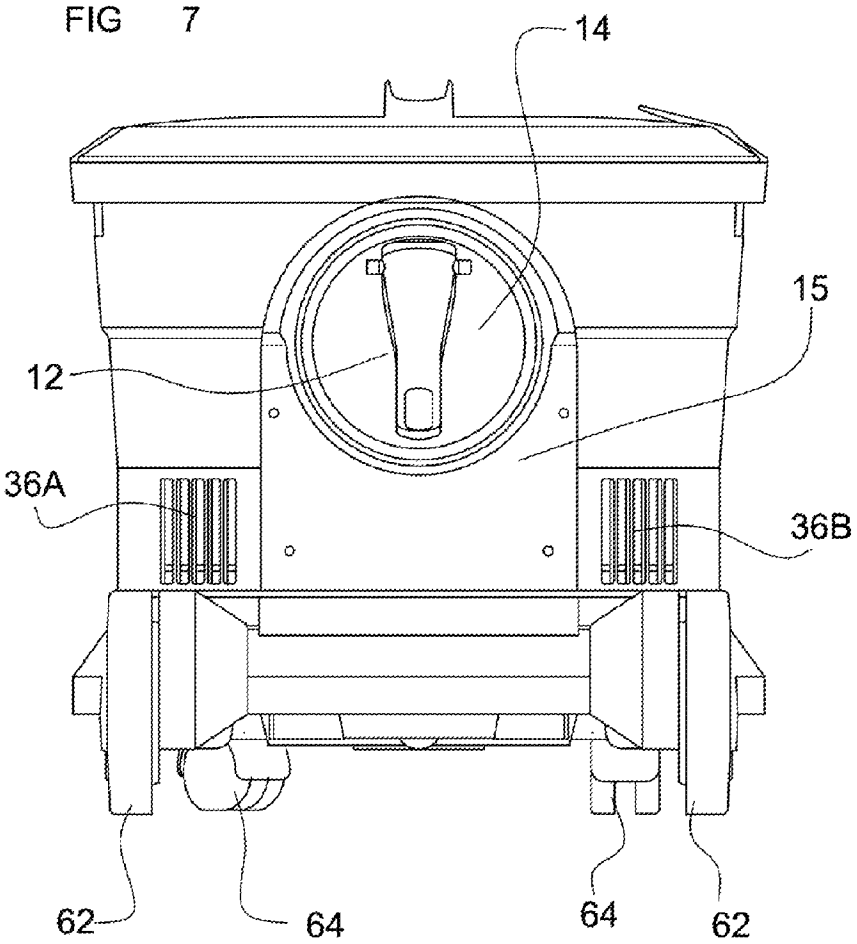
FIG. 7 shows the suction cleaner according to the invention from the rear.
Figure 10:
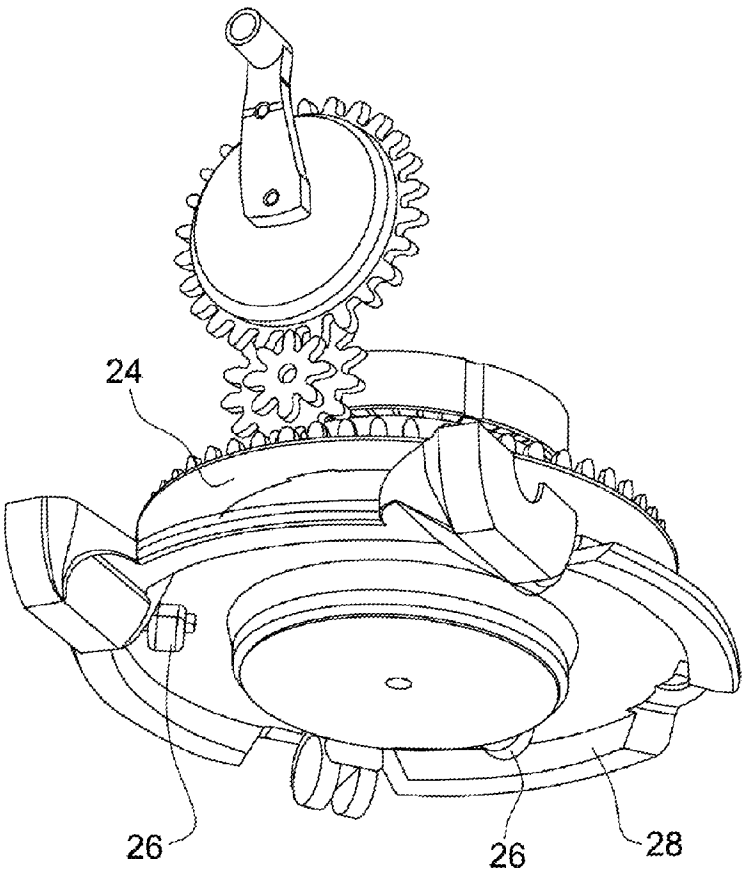
FIGS. 9 and 10 show, diagrammatically, from different viewpoints the relationship between operative components of a cable winding assembly of the suction cleaner according to the invention.

Referring now to FIG. 3, the operative internal components of the invention can be seen. A hose inlet 52 near the uppermost edge of the body 50 provides fluid communication from an external suction hose to a bag-receiving compartment 42, inside which a dust collection bag 44 is disposed. The motor 32 is housed in a compartment partially below the bag-receiving compartment 42, separated therefrom by wall 34, and is in fluid communication with the bag-receiving compartment 42 by way of a duct 46 and motor compartment air inlet aperture 40, the duct inlet 48 being disposed adjacent the top of bag-receiving compartment 42 facing the lid 54. The path of suction airflow in the cleaner is shown at A in the drawings, entering the suction cleaner 60 through the hose inlet 52, passing through the upper corner of bag 44 and into duct inlet 48. The air passes downwardly through duct 46, which is shaped to direct the air radially inwards and into the motor 32 through motor compartment air inlet 40.

Figure 4:
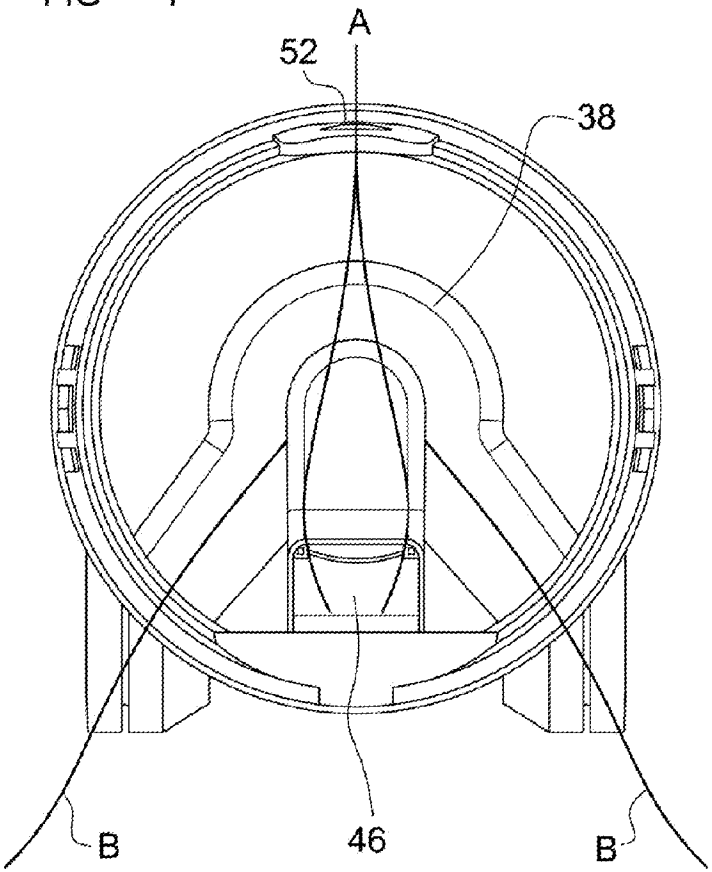
FIG. 4 is a cutaway view of the suction cleaner according to the invention from above, with a visual representation of the paths of airflow therein.

FIG. 4 shows the path of exhaust airflow from the motor/fan assembly 32. The inlet air path A is shown, and the exhaust airflow B is through an exhaust duct 38 leading to exhaust outlet vents 36A and 36B.

FIGS. 7, 8, 9 and 10 show the operative components of the cable reel 24 and its winding mechanism 10 according to the invention. The winding mechanism 10 comprises a gear wheel 14 having a handle 12 and peripheral teeth 16, the gear wheel 14 being rotatably supported on the body 50 by a bearing assembly 17, behind an access panel 15. The gear wheel's teeth 16 engage with the teeth of a smaller-diameter portion 18 of a secondary gear wheel also having a larger-diameter portion 20, whose teeth engage with teeth 22 on the cable reel 24. These gears allow the rotational movement provided by the user to be translated into rotation of the cable reel 24 at a convenient gear ratio.

The cable reel as above-described provides for storage of a sufficient length of flexible electrical power supply cable or cord to enable the cleaner to be moved around and used within a reasonable distance, e.g. a few metres, of a mains electrical power supply socket outlet. When substantially all the length of such a cable is stored on the reel within the body of the cleaner, the plug connector at the end thereof may fit in a receiving formation provided at an externally-accessible part of the body 50 or base 29, accessible so that by pulling the plug and cable sufficient of the cable for use of the cleaner in the required position can be drawn from the cable reel. After use of the cleaner, the user may turn the handle 12 of gear wheel 14 to rotate the cable reel 24 and thereby wind the cable back onto the reel.

Figure 11:
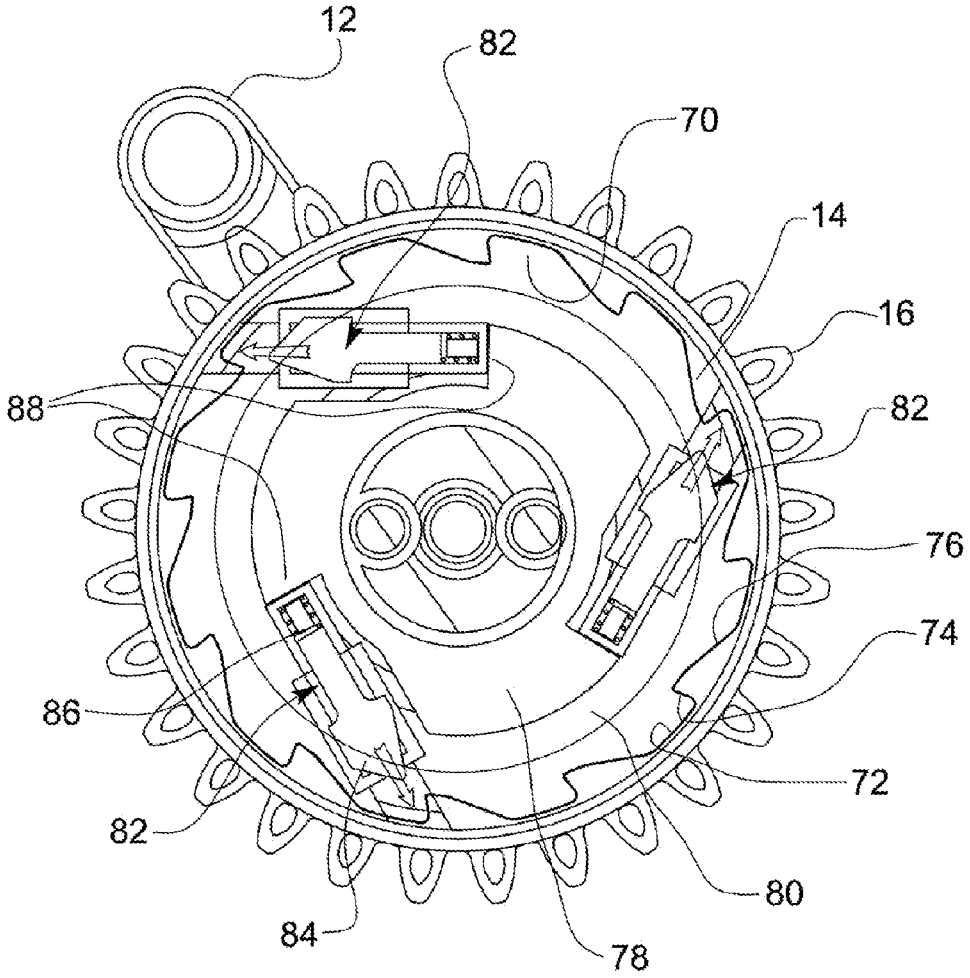
FIG. 11 illustrates a one way drive mechanism which may be incorporated in the cable winding assembly of the cleaner according to the invention.

To avoid rotation of the gear wheel 14 with its handle 12 when the cable is being drawn off the cable reel, a one-way operable driving mechanism may be incorporated in the drive train between the handle 12 and the cable reel. FIG. 11 illustrates one arrangement by which such one-way drive mechanism may be provided in association with the gear wheel 14.

FIG. 11 shows, diagrammatically, the gear wheel 14 with its gear teeth 16 on its external periphery. In its interior, it has a number of circumferentially spaced engagement formations 70 each with a circumferentially extending wall portion 72, a drive wall 74 inclined so as to define slightly less than a right angle between it and the circumferential wall 72, and a lead-in wall 76 defining an obtuse angle between it and the circumferential wall 72, facing the interior of the gear wheel 14.

The handle 12 is connected to a hub part 78 in a central region of the gear wheel 14, and operatively interposed between the hub part 78 and gear wheel 14 there is a drive member 80 which carries three circumferentially spaced drive elements indicated generally at 82. The drive elements 82 are supported in recesses in the drive member 80 and each has a nose portion 84 shaped to engage the acute angle between the circumferential wall 72 and drive wall 74 of each of the recesses 70 in the gear wheel 14. The drive elements are moveable in their respective recesses and are lightly spring biased inwardly of their respective recesses by springs 86, so that their nose portions 84 are clear of the engagement formations 70 in the gear wheel. The hub member 78 has engagement faces 88 which are engageable with rear portions of the drive elements 82, so that when the hub portion 78 is turned in the anti-clockwise direction (with reference to FIG. 11) by the handle 12 it moves angularly relative to the drive member 80 so that the drive elements are urged outwardly of their recesses in the member 78 into engagement with the drive walls and circumferential walls of the most closely-adjacent ones of the formations 70 in the gear wheel 14, so that continuing rotation of the handle 12 in the anti-clockwise direction will turn the gear wheel 16 thereby causing the cable reel to be rotated in the direction to cause the cable to be wound onto the reel. When such rotation of the cable has ceased, e.g. when the cable has been completely wound onto the reel, cessation of turning of the handle 12 will enable drive elements 82 to retract back into their recesses in the member 78, so that there is no driving connection between the handle and the gear wheel 14. The cable may be drawn off the reel without causing rotation of the handle 12.

In use of the cleaner described above, the disposition of the inlet 48 leading to the suction-creating means at the upper end of the bag-receiving compartment at 42 has the effect that a high fill ratio of the bag can be attained. In addition, the disposition of electric motor and fan assembly 32 at the base of the cleaner gives the cleaner a low centre of gravity, assisted by the disposition of the cable reel around the motor.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A suction cleaner comprising:

a body;

a compartment for accommodating a dust collection bag;

a source of suction for causing suction airflow into the dust collection bag, wherein the source of suction is disposed at least partially beneath the compartment and communicates therewith by a passage which extends from an upper region of the compartment;

a cable storage device for an electrical cable;

wherein the cable storage device comprises a cable reel;

wherein the cable reel is rotatable by a manually operable rotary member; and wherein the manually operable rotary member is disposed at a side part of the body of the cleaner.

2. A suction cleaner according to claim 1 wherein the passage is afforded by a duct extending upwardly from the source of suction and terminating adjacent an upper surface of the compartment.

3. A suction cleaner according to claim 2 wherein the duct terminates at a position in the compartment generally opposite a hose inlet to the compartment.

4. A suction cleaner according to claim 1 wherein the cable storage device is in a lower part of the body.

5. A suction cleaner according to claim 1 wherein the cable reel is disposed surrounding a part of the source of suction of the cleaner.

6. A suction cleaner according to claim 1 wherein a one-way drive device is provided between the cable reel and rotary member.

7. A suction cleaner according to claim 6 wherein the manually operable rotary member is disposed at a side part of the body of the cleaner.

8. A suction cleaner according to claim 7 wherein the rotary member is rotatable about an axis extending transversely of the body.

9. A suction cleaner according to claim 6 wherein the rotary member is rotationally connected to the cable reel by gearing.

10. A suction cleaner according to claim 6 wherein the cable reel is disposed surrounding a part of the source of suction of the cleaner.

11. A suction cleaner according to claim 1 wherein the rotary member is rotatable about an axis extending transversely of the body.

12. A suction cleaner according to claim 1 wherein the rotary member is rotationally connected to the cable reel by gearing.

13. A suction cleaner according to claim 12 wherein the cable reel is disposed surrounding a part of the source of suction of the cleaner.

14. A suction cleaner comprising a body;

a dust collection compartment;

a source of suction for causing suction airflow into the dust collection compartment; and a cable storage device for an electrical cable;

wherein the cable storage device comprises a cable reel;

wherein the cable reel is rotatable by a manually operable rotary member; and the manually operable rotary member is disposed at a side of the body, the cable storage wheel rotatable by the manually operable rotary member.

15. A suction cleaner according to claim 14 wherein a one-way drive device is provided between the cable reel and rotary member.

16. A suction cleaner according to claim 14 wherein the rotary member is rotatable about an axis extending transversely of the body.

17. A suction cleaner according to claim 14 wherein the rotary member is rotationally connected to the cable reel by gearing.

18. A suction cleaner according to claim 14 wherein the cable reel is disposed surrounding a part of the source of suction of the cleaner.

19. A suction cleaner according to claim 14, wherein the source of suction is disposed at least partially beneath the dust collection compartment.

20. A suction cleaner according to claim 14, wherein the cable storage device is in a lower part of the body.

* * * * *